US010646872B2

(12) United States Patent
Triva

(10) Patent No.: US 10,646,872 B2
(45) Date of Patent: May 12, 2020

(54) SUPPORT FOR CONSERVING A SAMPLE OF BIOLOGICAL MATERIAL AND A METHOD FOR PRODUCTION THEREOF

(71) Applicant: Copan Italia S.p.A., Brescia (IT)

(72) Inventor: Daniele Triva, Bovezzo (IT)

(73) Assignee: Copan Italia S.p.A., Brescia (IT)

( * ) Notice: Subject to any disclaimer, the term of this patent is extended or adjusted under 35 U.S.C. 154(b) by 269 days.

(21) Appl. No.: 14/909,949

(22) PCT Filed: Jun. 23, 2014

(86) PCT No.: PCT/IB2014/062528
§ 371 (c)(1),
(2) Date: Feb. 3, 2016

(87) PCT Pub. No.: WO2015/019205
PCT Pub. Date: Feb. 12, 2015

(65) Prior Publication Data

US 2016/0184815 A1 Jun. 30, 2016

(30) Foreign Application Priority Data

Aug. 7, 2013 (IT) ..... MI2013A1354

(51) Int. Cl.
*B01L 3/00* (2006.01)

(52) U.S. Cl.
CPC ..... *B01L 3/505* (2013.01); *B01L 13/02* (2019.08); *B01L 2200/12* (2013.01);
(Continued)

(58) Field of Classification Search
CPC ..... B01L 3/505; B01L 2300/0809
See application file for complete search history.

(56) References Cited

U.S. PATENT DOCUMENTS 3,996,006 A * 12/1976 Pagano ..... G01N 33/525 422/50
4,225,557 A 9/1980 Hartl et al.
(Continued)

FOREIGN PATENT DOCUMENTS

CN 101657261 A 2/2010
FR 2396299 1/1979
(Continued)

OTHER PUBLICATIONS

PCT International Search Report and Written Opinion of the International Searching Authority, PCT/IB2014/062528, dated Nov. 4, 2014, 15 pages.
(Continued)

*Primary Examiner* — Krishnan S Menon
*Assistant Examiner* — Dwan A Gerido
(74) *Attorney, Agent, or Firm* — Fish & Richardson P.C.

(57) ABSTRACT

A support for conserving samples of biological material comprising at least: a first portion of an absorbent material aimed at and destined to conserve a sample of biological material and a second portion, distinct from the first portion and aimed at, predisposed and destined to constitute a cleaning zone for a head of a device, in particular a punch, aimed at collecting a sample of biological material from the first portion. The support can further comprise a third portion of connection interposed between the first portion and the second portion; the third portion can exhibit one or more cuts or one or more openings.

6 Claims, 6 Drawing Sheets

(52) U.S. Cl.
CPC ... *B01L 2200/141* (2013.01); *B01L 2300/069* (2013.01); *B01L 2300/0672* (2013.01); *B01L 2300/0803* (2013.01); *B01L 2300/0809* (2013.01); *B01L 2300/0816* (2013.01); *B01L 2300/126* (2013.01)

(56) References Cited

U.S. PATENT DOCUMENTS

| | | | | |
|---|---|---|---|---|
| 5,182,191 | A * | 1/1993 | Fan | A61B 10/0038 422/256 |
| 6,165,416 | A | 12/2000 | Chandler | |
| 7,288,413 | B2 | 10/2007 | Goulden | |
| 7,556,769 | B2 * | 7/2009 | Kikta | A61B 10/0038 206/459.1 |
| 7,718,126 | B2 * | 5/2010 | Kikta | A61B 10/0038 206/459.1 |
| 2005/0037510 | A1 * | 2/2005 | Sharrock | G01N 21/274 436/164 |
| 2007/0037296 | A1 | 2/2007 | Goulden | |
| 2007/0134811 | A1 * | 6/2007 | Takeuchi | G01N 33/558 436/514 |
| 2008/0299605 | A1 | 12/2008 | Lary et al. | |
| 2010/0047129 | A1 * | 2/2010 | LaStella | A61B 10/0038 422/68.1 |

FOREIGN PATENT DOCUMENTS

| | | | |
|---|---|---|---|
| FR | 2907654 | | 5/2008 |
| RU | 2418633 | C2 | 5/2011 |
| WO | WO9003959 | A1 | 4/1990 |
| WO | WO0076664 | | 12/2000 |
| WO | WO2006056658 | A1 | 6/2006 |

OTHER PUBLICATIONS

Search Report, Russian Registration No. 2016107595/05, dated Mar. 28, 2018, 4 pages.

Avioq, Inc., "Package Insert—Avioq HIV-1 Microelisa System," Product package insert, Aug. 2009, 30 pages.

Office Action issued in Chinese Application No. 201480044860.3 dated Jun. 22, 2018. 14 pages (with English translation).

Office Action issued in Chinese Application No. 201480044860.3 dated May 1, 2017, 25 pages (with English translation).

Office Action issued in Chinese Application No. 201480044860.3 dated Sep. 10, 2017, 23 pages (with English translation).

US Food & Drug Administration [online], "Sep. 21, 2009 Letter," Premarket Approvals (PMAs): Avioq HIV-1 Microelisa System, available on or before Jan. 12, 2017, [retrieved on May 9, 2019], via Internet Archive: <http://wayback.archive-it.org/7993/20170112212249/http://www.fda.gov/BiologicsBloodVaccines/BloodBloodProducts/ApprovedProducts/PremarketApprovalsPMAs/ucm185265.htm>, 3 pages.

US Food & Drug Administration [online], "Avioq HIV-1 Microelisa System," Vaccines, Blood & Biologics: Approved Blood Products, last updated Mar. 6, 2018, [retrieved on: May 9, 2019], retrieved from: URL<https://www.fda.gov/vaccines-blood-biologics/approved-blood-products/avioq-hiv-1-microelisa-system>, 1 page.

US Food & Drug Administration, "Avioq HIV-1 Microelisa System: Summary of Safety and Effectiveness," Aug. 10, 2009, 18 pages.

* cited by examiner

SUPPORT FOR CONSERVING A SAMPLE OF BIOLOGICAL MATERIAL AND A METHOD FOR PRODUCTION THEREOF

CROSS-REFERENCE TO RELATED APPLICATIONS

This application is a U.S. National Phase Application under 37 U.S.C. § 371 and claims the benefit of priority to International Application No. PCT/IB2014/062528, filed on Jun. 23, 2014, which claims the benefit of priority to Italian Application No. MI2013A001354, filed on Aug. 7, 2013, the contents of which are hereby incorporated by reference.

The concepts herein relate to a support for conserving samples of biological material, in particular a support comprising an absorbent matrix aimed at receiving and conserving the sample. The concepts herein further relate to the production method of the support.

The invention is especially applicable for enabling, using a single support, conservation of a sample of biological material and the cleaning of a device aimed at collecting a sample of biological material from the matrix support.

Supports are known for conserving samples of biological material comprising a matrix, usually made of an absorbent material. The absorbent material can be constituted by a cellulose base material, such as for example paper, in particular absorbent paper or filter paper, specifically treated, in particular chemically, for enabling absorbance and conservation of collected samples of biological material. This type of paper is known, for example, from patent application WO9003959 (BURGOYNE). It is known that after having carried out the collection of samples of biological material by special devices (for example tampons of various nature, in particular for example flocked), the collected samples are transferred onto matrix supports of the previously-described type. Following transfer of the samples onto the matrix supports, a portion of this sample can be collected from the matrix support for the aim, for example, of being subsequently analyzed. The collecting step of a sample from the support can be done using a known collecting device that can separate a small portion of matrix support from the support. In the context of the present description, the term "collecting device" is understood to mean a device aimed at collecting a sample of biological material from a matrix support aimed at conserving the biological material; an example of a collecting device can be constituted by a punch or by a manual or automatic punch machine. A punch machine aimed at collecting a sample of biological material from a matrix support made of paper is, for example, known from patent application WO2006056658 (LEHTINEN).

Collecting devices are usually provided with one or more surfaces which, on entering into contact with the support for conserving biological material, are aimed at removing a sample of biological material from the support. In particular, when the collecting device is constituted by a punch, the removed portion of the matrix can be disc-shaped. Following the removal of a sample of biological material from the matrix support it is appropriate and advisable to clean the surface of the surfaces responsible for the collection so as to be aimed at proceeding to a following collection of a further sample of biological material using the same collecting device. The cleaning is done with the aim of preventing contamination by the collecting device of the next support from which the sample of biological material is to be collected. This contamination might for example occur because of the presence of biological residues and/or impurities at the surfaces of the collecting device aimed at collecting the sample of biological material from the support. For this reason, after having collected a sample of biological material from the matrix support and before proceeding to the removal of a further sample from a different, following or further matrix support, it is advisable to appropriately clean the surfaces of the device aimed at collecting the sample, which are the surfaces belonging to the head of the punch; otherwise, proceeding with the second collection without having first cleaned the collecting device might lead to the risk of contamination of the support and/or the biological material conserved in the support.

It is known to perform a cleaning of the collecting device using a special cleaning support, distinct from the conserving support. For example, if the collecting device of a sample of biological material from a first support is a punch, according to the known cleaning method the cleaning thereof is done by a single "blank" punching of a "virgin"—i.e. uncontaminated—cleaning support, in particular an absorbent matrix, so that the contact between the head of the punch and the second support enables the removal of the biological residues and/or the impurities present on the punch. By "virgin" support, in the context of the concepts herein, is meant a matrix support, or a portion thereof, on which no sample of biological material has been deposited, while by "blank" punching is meant the operation consisting in punching a virgin support with the aim of cleaning the punch. In the present description, "cleaning zone" refers to a zone in which no sample of biological material is to be deposited, i.e. in other terms a "virgin" zone, free of biological samples before the interaction with the head of the device, In particular the punch, for cleaning of the punch. The known method is complex, as it requires the handling of both the conservation supports and the cleaning supports, leading to various drawbacks among which at least an increase in costs and a lengthening of the process times.

In certain instances, the concepts herein obviate one or more of the problems encountered in the prior art.

In certain instances, the concepts herein enable conservation of one or more samples of biological material, the collecting of one or more samples of biological material from a matrix support and the cleaning of the collecting device, in particular a punch, in a simple and efficient way.

In certain instances, the concepts herein facilitate the cleaning process of the surfaces of the collecting device aimed at entering into contact with the biological material with the aim of collecting a sample thereof.

In certain instances, the concepts herein provide a support capable of making possible a simpler and faster cleaning of the collecting device.

In certain instances, the concepts herein provide a support capable of simplifying and accelerating the collecting operations of a sample of biological material from the support.

In certain instances, the concepts herein provide a production method of a support for conservation of a sample of biological material that is simple and rapid to implement.

These aspects and others besides, which will emerge more fully from the following description, are substantially attained by a support for conserving a sample of biological material according to what is set down in one or more of the appended claims, taken alone or in combination with one another or in combination with any one of the further aspects or characteristics described in the following.

According to one or more aspects of the concepts herein, each of which can be taken alone or in combination with any one of the dependent claims or the other aspects indicated in the following, the concepts herein can further relate to a support for the conservation of samples of biological material, in which:

- the first and/or the second opening exhibit a substantially rectangular shape or substantially square shape, or a substantially circular shape or a substantially elliptical shape;
- in operating conditions of the containing body, one or more cuts in the first layer are positioned at, and in particular above, one or more cuts in the third portion;
- in operating conditions of the containing body, one or more cuts of the second layer are positioned at, and in particular below, one or more cuts of the third portion;
- the opening of the absorbent matrix, at the position of the third portion, exhibits a substantially circular shape or substantially rectangular shape or substantially elliptical shape;
- the first portion, the absorbent matrix and/or the second portion and/or the third portion are made of an absorbent plastic material or another absorbent material suitable for the purpose;
- the first layer and/or the second layer and/or the containing body are made of an at least partially-rigid material and/or a material exhibiting a greater rigidity than the absorbent matrix;
- the first layer and/or the second layer and/or the containing body are configured for giving structural solidity to the containing body;
- the first layer and/or the second layer are made of a paper material or are made of cardboard or of a plastic material;
- the first and the second portion are distinct and/or individually applied to the containing body;
- the first layer and the second layer are characterised by the presence of at least a cut or at least two cuts or a plurality of cuts, interposed between the first opening and the second opening;
- the first layer, the second layer and the third portion are characterised by a same number of cuts and/or wherein the cuts are positioned in corresponding positions on the first layer, the second layer and/or the third portion;
- one or more cuts are made by die-cutting or punching the third portion after assembly in the external containing body or before assembly in the external containing body;
- the opening of the absorbent matrix is realised by die-cutting or punching of the third portion after assembly in the external containing body or before assembly in the external containing body;
- the second portion is a "virgin" zone and/or a zone without biological samples before the interaction with the head of the device, in particular the punch, for cleaning thereof;
- the second portion comprises a cleaning zone for the head of a device, in particular a punch, aimed at collecting a sample of biological material from the first portion;
- the second portion is made of absorbent material or in another material able to clean the head of the collecting device when in contact with it.

According to one or more aspects of the concepts herein, each of which can be taken alone or in combination with any one of the method claims or other aspects, the concepts herein can relate to a method for production of a support for conservation of samples of biological material according to one or more of the claims or the other previously-indicated aspects, in which:

- the method comprises a step of inserting the first portion and the second portion and/or the third portion and/or the absorbent matrix internally of the containing body;
- the step of realising one or more cuts or an opening in the absorbent matrix at the third portion is carried out before the step of inserting the first portion and the second portion and/or the third portion and/or the absorbent matrix internally of the containing body;
- the step of realising one or more cuts or an opening in the absorbent matrix at the third portion is carried out after the step of inserting the first portion and the second portion and/or the third portion and/or the absorbent matrix internally of the containing body;
- in operating conditions of the containing body one or more cuts of the first layer are located at, in particular superiorly of, one or more cuts of the third portion; and one or more cuts of the second layer are located at, in particular inferiorly of, one or more cuts of the third portion;
- the step of realising one or more cuts or an opening in the absorbent matrix at the third portion is realised by die-cutting or punching of the third portion after an assembly in the external containing body or before the assembly of the external containing body;
- the first and the second layer exhibit at least a first and a second opening, in operating conditions of the containing body the first portion being arranged at, and coinciding with, the first opening and the second portion being arranged at, and coinciding with, the second opening;
- the first opening of the first and/or the second layer of the containing body exhibits a substantially rectangular shape or substantially square shape or substantially circular shape or substantially elliptical shape;
- the absorbent matrix is cellulose-based and/or is made of a paper material;
- the first portion, the absorbent matrix and/or the second portion and/or the third portion are made of an absorbent plastic material or of a further absorbent material suitable for the purpose;
- the first layer and/or the second layer are made of an at least partially rigid material and/or a material exhibiting a greater rigidity than the absorbent matrix, and/or are configured for giving external structural solidity to the containing body;
- the first layer and/or the second layer are made of a paper material or of cardboard or a plastic material.

In a further aspect of the concepts herein, which can be taken alone or in combination with any one of the claims or the other aspects indicated, the concepts herein can further relate to the use, for the conservation of a sample of biological material, of a support according to any one of the claims. In a further aspect of the concepts herein, which can be taken alone or in combination with any one of the claims or the other aspects indicated, the concepts herein can further relate to the use, for the conservation of a sample of biological material, or a support comprising at least: a first portion of an absorbent matrix aimed at and destined for conserving a sample of biological material; and a second portion, distinct from the first portion and aimed at, predisposed and destined to constitute a cleaning zone for a head of a device, in particular a punch, aimed at collecting a sample of biological material from the first portion.

A detailed description will now be made of one or more preferred embodiments of the concepts herein, by way of non-limiting example, in which.

Figure 1:
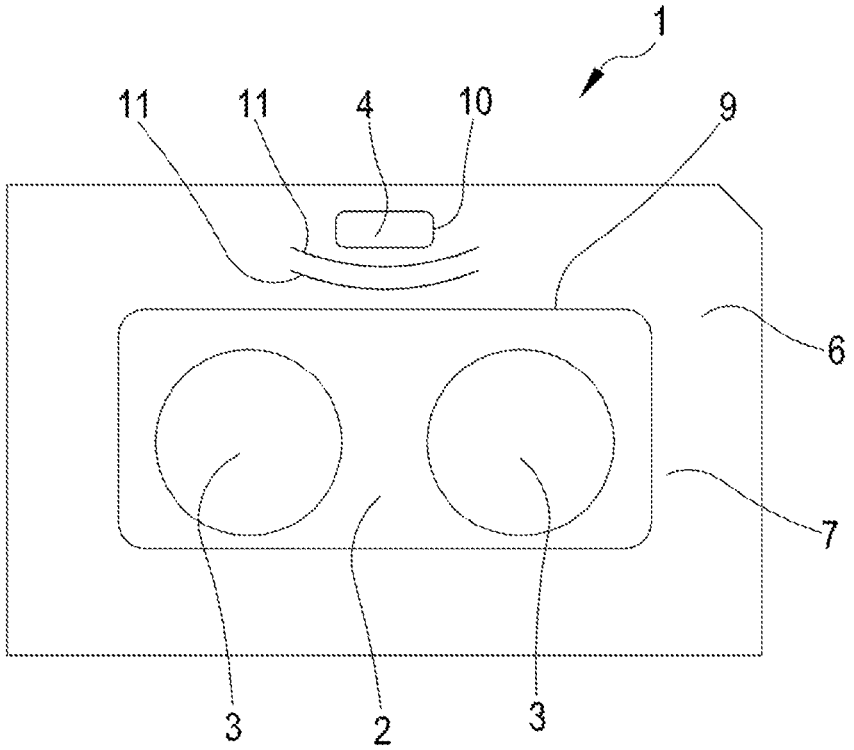
FIG. 1 is a frontal view of a support according to a preferred embodiment of the concepts herein.

With reference to the figures, 1 denotes in its entirety a support for conservation of one or more samples of biological material.

The support 1 comprises at least an absorbent matrix 2, where the absorbent matrix 2 is a matrix support or any other means aimed at and predisposed to collect and conserve samples of biological material. The absorbent matrix 2 can preferably be made of a cellulose-based material, for example a paper material, in particular absorbent paper or filter paper.

The support 1 further comprises at least a first portion 3 and a second portion 4; the first portion 3 is a portion of the absorbent matrix 2. The first portion 3 of the absorbent matrix 2 is aimed at and destined for absorbing and conserving a sample of biological material and can be appropriately chemically treated so as to increase the conservation of biological material even for a long period of time.

The conservation of samples of biological material is fundamental in applications in which there is a need to process the biological material collected, for example so as to carry out analyses, and later, even after a long time with respect to the moment of depositing of the sample to be analyzed on the absorbent matrix 2. The second portion 4 is aimed at and predisposed to constitute a cleaning zone for the surfaces of the collecting device which have entered into contact with the absorbent matrix 2, in particular at the first portion 3, on the act of collecting the sample of biological material.

In particular, the surfaces can belong to the head of a collecting device. In the context of the present description, by head of a collecting device is meant one or more surfaces and/or portions of the collecting device aimed at removing a sample of biological material from the absorbent matrix 2, in particular at the first portion 3 of the absorbent matrix 2.

For example, in a case in which the collecting device is a punch, the surfaces aimed at entering into contact with the biological material at the first portion 3 so as to remove a sample belonging to the head of the punch. If the collecting device is a punch, its cleaning can be performed by "blank" punching of the second portion 4 once or more so that the material with which the second portion 4 is realized can remove the residues of biological material and/or the impurities present on the surfaces of the collecting device aimed at collecting portions of is samples of biological material from the support 1. With the aim of efficiently completing the cleaning and in order to prevent contamination of the collecting device, no sample of biological material is deposited at the second portion 4 with the aim of conserving the sample; in this way the second portion 4 is maintained in a virgin state.

The second portion 4 can be made of an absorbent material or any other material aimed at cleaning the head of the collecting device when in contact therewith. The second portion 4 can belong to the absorbent material 2, or in a variant it can be an element that is distinct from the absorbent matrix. The first portion 3 and the second portion 4 can be made of a same material or different materials and/or can exhibit different characteristics from one another, acquired for example via one or more specific processes to which they are subjected. In particular the first portion 3 can be configured, for example by addition of specific substances for the purpose, for absorbing and conserving samples of biological material, while the second portion 4 can be configured for absorbing and/or removing residues of biological material and/or impurities present on the surfaces of the collecting device aimed at collecting portions of samples of biological material on the support 1.

The support 1 can further comprise a third portion 5; in particular the third portion 5 can be interposed between the first portion 3 and the second portion 4. The third portion 5 can preferably be a connecting portion between the first portion 3 and the second portion 4. The third portion 5 can belong to the absorbent matrix 2; in other words the third portion 5 can be a portion of the absorbent matrix 2.

Figure 6:
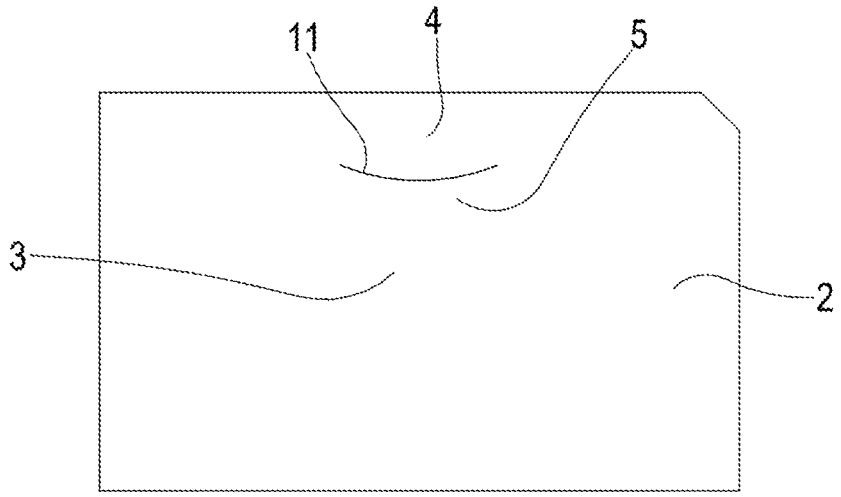
FIG. 6 is a frontal view of an absorbent matrix according to an embodiment of the concepts herein.
Figure 7:
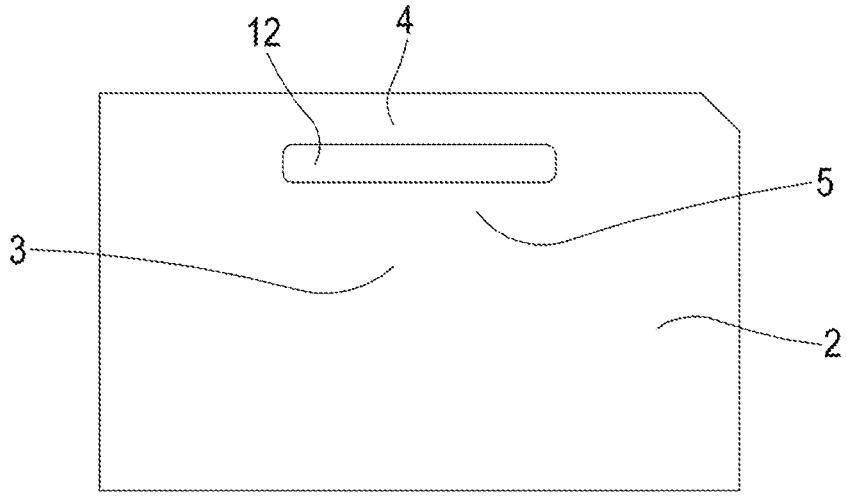
FIG. 7 is a frontal view of an absorbent matrix according to a variant of the concepts herein.
Figure 8:
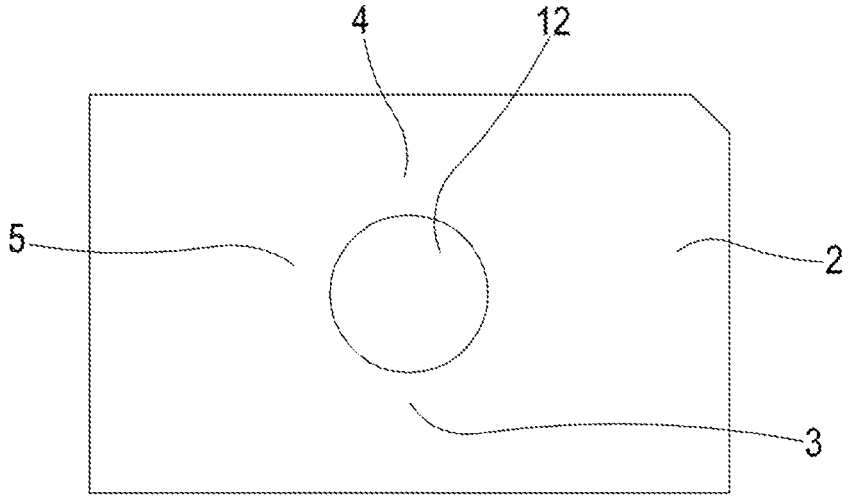
FIG. 8 is a frontal view of an absorbent matrix according to a second variant of the concepts herein.
Figure 9:
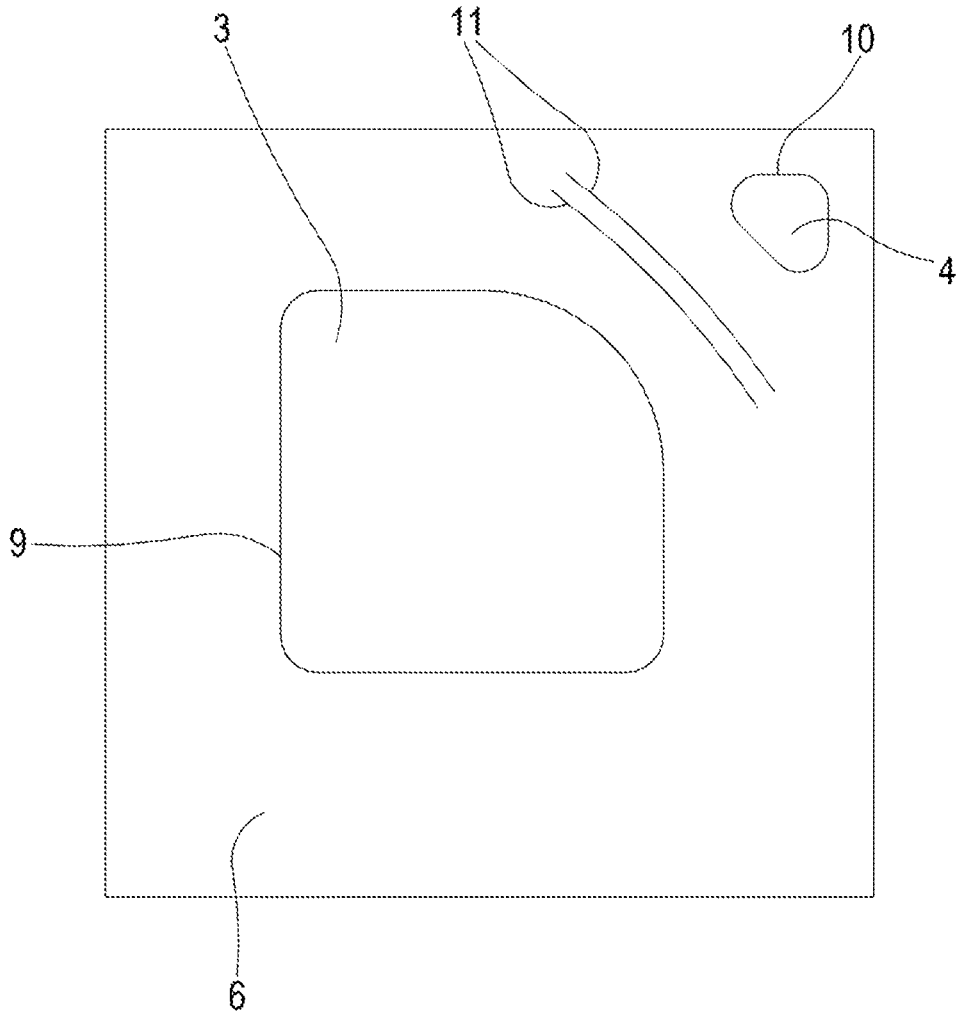
FIG. 9 is a frontal view of a support according to an embodiment of the concepts herein.

In a preferred embodiment of the concepts herein the first portion 3, the second portion 4 and the third portion 5 are portions of the absorbent matrix 2, as illustrated in FIGS. 6 to 8. The first portion 3 and/or the second portion 4 and/or the third portion 5 and/or the absorbent matrix 2 can be made of a cellulose-based material and/or a paper material, for example absorbent paper or filter paper.

The support 1 for conserving biological material can comprise an external containing body 6, which can be internally hollow so as to be able to house, at least partially therein, and preferably completely, the first portion 3, the second portion 4 and/or the absorbent matrix 2. In other terms, the containing body 6 can exhibit one or more seatings destined for housing the first portion 3, the second portion 4 and/or the absorbent matrix 2. In particular, in operating conditions of the containing body 6, the first portion 3 and the second portion 4 can be arranged internally of the containing body 6, as illustrated for example in FIGS. 1 to 5 and from 9 to 11.

By operating conditions of the containing body 6 is meant the condition in which at least the first portion 3 and the second portion 4 are arranged internally of the containing body 6. In particular, in operating conditions of the containing body 6, the first portion 3 and the second portion 4 are appropriately positioned internally of the containing body 6 such that the first portion 3 is predisposed for depositing a sample of biological material for conservation thereof or for collecting a sample of biological material and the second portion 4 is predisposed for cleaning the collecting device. The first portion 3 and the second portion 4 can be distinct and/or applied individually on the support 1, in particular to the containing body 6.

The first and the second portion 3, 4 can be for example applied to the support 1 by gluing to the first and/or the second layer 7, 8 of the containing body 6. The absorbent matrix 2 can exhibit a shape enabling a simple and optimal positioning internally of the containing body 6; for example, the absorbent matrix 2 can exhibit the same geometrical shape as the containing body 6, while they can have different dimensions. In particular, the absorbent matrix 2 can be characterised by smaller dimensions with respect to the containing body 6 in such a way as to facilitate the housing thereof internally of the containing body 6. In an embodiment in which the absorbent matrix 2 exhibits the same dimensions as the containing body 6, the second and the third portion 4, 5 can belong to the absorbent matrix 2. From the structural point of view, the containing body 6 can comprise a first and a second layer 7, 8. The first layer 7 of the containing body 6 can be located superiorly with respect to the first portion 3 and the second portion 4 and/or the absorbent matrix 2 and the second layer 8 of the containing body 6 can be located inferiorly with respect to the first portion 3 and the second portion 4 and/or the absorbent matrix 2.

Figure 4:
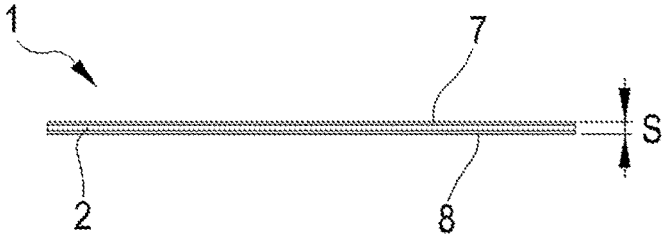
FIG. 4 is a view from below of the support of FIG. 3.

For example, FIG. 4 illustrates the first and the second layer 7, 8 respectively located superiorly and inferiorly with respect to the absorbent matrix 2. In particular, the absorbent matrix 2 can exhibit the same geometrical profile as the first layer 7 and/or the second layer 8 of the containing body 6.

In operating conditions of the containing body 6, the first portion 3 and the second portion 4 and/or the absorbent matrix 2 can be arranged internally of the containing body 6 between the first layer 7 located superiorly of the first and the second portion 3, 4 and/or the absorbent matrix 2 and the second layer 8 located inferiorly with respect to the first and the second portion 3, 4 and/or the absorbent matrix 2. The first layer 7 and/or the second layer 8 and/or the containing body 6 can preferably be made of an at least partially-rigid material and/or exhibiting a greater rigidity with respect to the absorbent matrix 2. The first layer 7 and/or the second layer 8 are preferably configured for giving external structural solidity to the containing body 6 with the aim, for example, of providing a sturdy housing seating for the first portion 3 and/or the second portion 4 and/or the absorbent matrix 2 which can be contained internally thereof. The first layer 7 and/or the second layer 8 and/or the containing body 6 can be made of a paper or of cardboard, or in further variants of a plastic material. From a structural point of view, at least one from between the first and the second layer 7, 8, in particular both, can exhibit a first and a second opening 9, 10. The first and second opening 9, 10 can preferably be through-openings with respect to the first layer 7 and/or the second layer 8. In other terms, the first layer 7 and/or the second layer 8 can exhibit two cavities, which are constituted by the first and the second opening 9, 10. Both the first and the second layer 7, 8 preferably exhibit a first and a second through-openings 9, 10.

Figure 10:
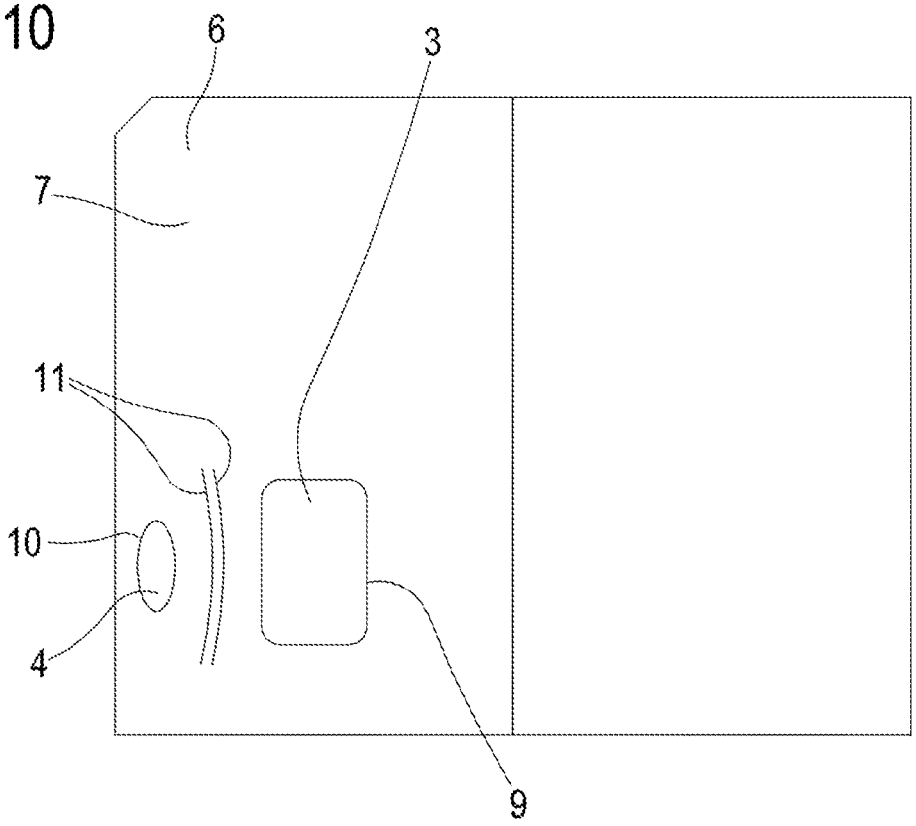
FIG. 10 is a frontal view of a support according to a further embodiment of the concepts herein in a first open condition.

The first and the second opening 9, 10 of the first layer 7 are illustrated for example in FIG. 1 and FIG. 10 where, as the first and the second opening 9, 10 are through-openings with respect to the first layer 7 and as the first portion 3 and the second portion 4 are housed internally of the containing body 6, the first portion 3 is illustrated below the first opening 9 of the first layer 7 of the containing body 6, and the second portion 4 is illustrated below the second opening 10 of the first layer 7 of the containing body 6.

Figure 11:
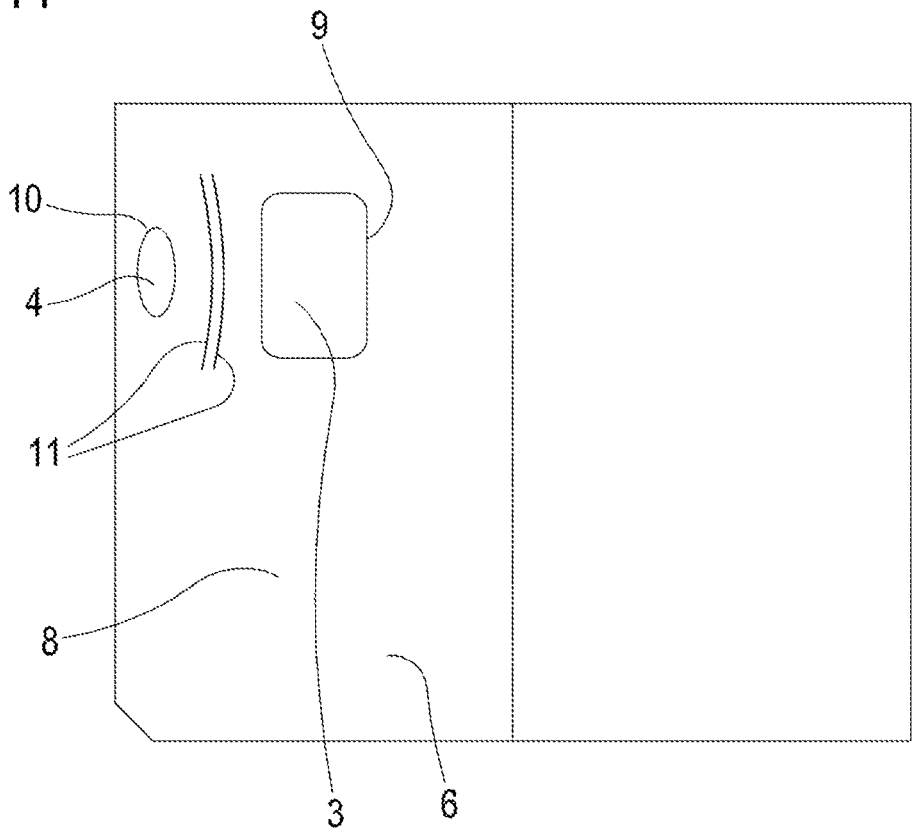
FIG. 11 is a rear view of the support of FIG. 10.

As regards the second layer 8 of the containing body 6, the first and the second through-openings 9, 10 are illustrated for example in FIG. 2 and in FIG. 11 where, as the first and the second openings 9, 10 are through-openings with respect to the second layer 8 and as the first portion 3 and the second portion 4 are housed internally of the containing body 6, the first portion 3 is illustrated below the first opening 9 of the second layer 8 of the containing body 6, and the second portion 4 is illustrated below the second opening 10 of the second layer 8 of the containing body 6.

With reference to the operating conditions of the containing body 6, the first portion 3 destined to conservation of a sample of biological material can advantageously be arranged at the first opening 9. This positioning of the first portion 3 can enable accessibility of the first portion 3 from externally of the containing body 6, as illustrated in FIG. 1 and FIG. 10 in relation to the first opening 9 of the first layer 7 and in FIG. 2 and FIG. 11 in relation to the first opening 9 of the second layer 8. In other terms, in the configuration in which the first portion 3 is located internally of the containing body 6 between the first layer 7 and the second layer 8, the first opening 9 of the first layer and/or of the second layer 8 make the first portion accessible from externally of the containing body 6. This accessibility is particularly useful for example for the aim of depositing a sample of biological material at the first portion 3 and/or collecting from the first portion 3, by a collecting device, a portion of the sample of biological material deposited there without having to extract the first portion 3 from the containing body 6.

Figure 5:
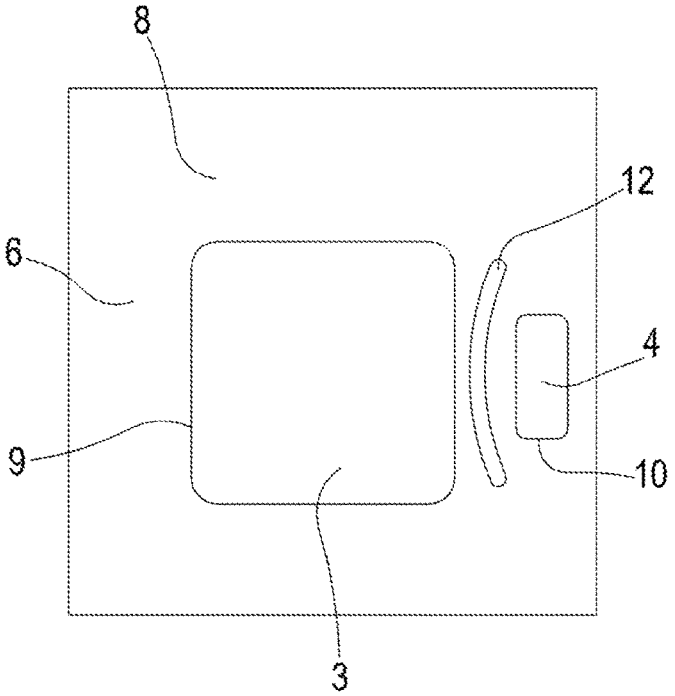
FIG. 5 is a rear view of the support of FIG. 3.

The first portion 3 can preferably coincide with the first opening 9 of the first layer 7 and/or of the second layer 8. By way of non-limiting example, the first opening 9 can exhibit a substantially rectangular shape, as illustrated in FIGS. 1 and 2, substantially square, as illustrated in FIGS. 3 and 5, or substantially circular or substantially elliptical. With reference to the operating conditions of the containing body 6, the second portion 4 can advantageously be arranged at the second opening 10. The positioning of the second portion 4 can enable accessibility of the second portion 4 from externally of the containing body 6, as illustrated in FIG. 1 and FIG. 10 in relation to the second opening 10 of the first layer 7 and in FIG. 2 and FIG. 11 in relation to the second opening 10 of the second layer 8.

In other terms, in the configuration in which the second portion 4 is located internally of the containing body 6 between the first layer 7 and the second layer 8, the second opening 10 of the first layer 7 and/or the second layer 8 make the second portion 4 accessible from externally of the containing body 6. This accessibility is particular useful for example for carrying out the cleaning of the head of a device, in particular a punch, aimed at collecting a sample of biological material from the first portion 3 without having to extract the second portion 4 from the containing body 6.

The second portion 4 can preferably coincide with the second opening 10 of the first layer 7 and/or the second layer 8. By way of non-limiting example, the second opening 10 can exhibit a substantially rectangular shape, as illustrated in figures from 1 to 3 and in FIG. 5, or substantially elliptical, as illustrated in FIGS. 10 and 11, or substantially circular. The second opening 10 can be characterised by smaller dimensions with respect to the first opening 9, as illustrated in FIG. 1 and FIG. 2.

From the structural point of view the containing body 6 can exhibit one or more additional portions, as illustrated in figures from 10 to 14. The additional portions of the containing body 6 can be for example aimed at supplying a greater structural solidity and/or an additional protection for the absorbent matrix 2, in particular for the first portion 3 and/or the second portion 4.

The additional portions can be reciprocally moved, for example by rotary movements aimed at mutually inclining and/or superposing the portions of the containing body 6. FIGS. 10 and 11 illustrate a support 1 according to an embodiment of the concepts herein provided with an additional portion in a first open condition, in which the additional portion lies substantially on the same plane with respect to the first and the second portion 3, 4 arranged internally of the containing body 6.

Figure 12:
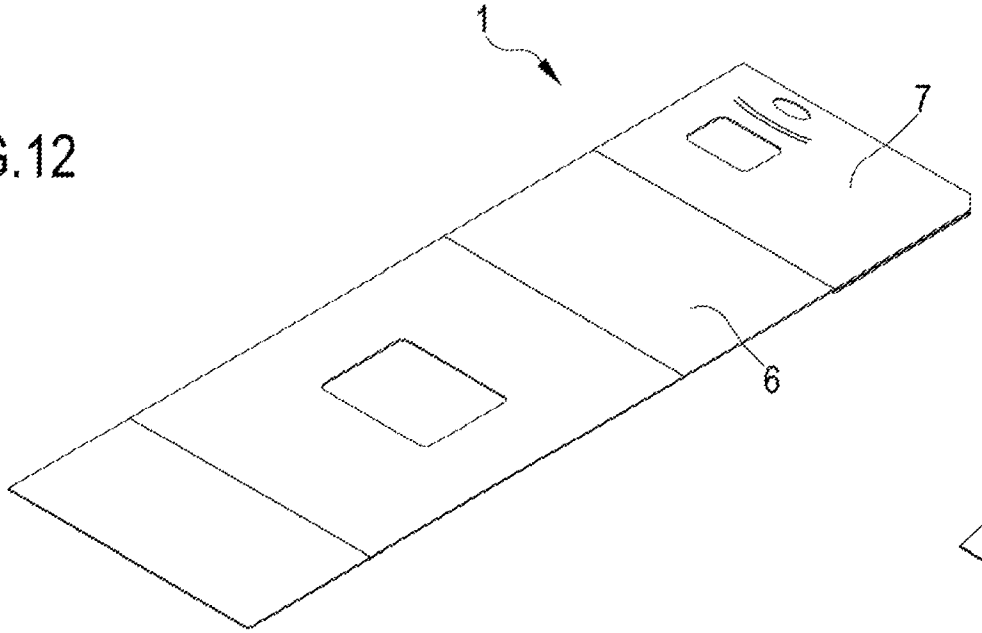
FIG. 12 is a perspective view of a support according to a further embodiment of the concepts herein in a second completely open position.
Figure 13:
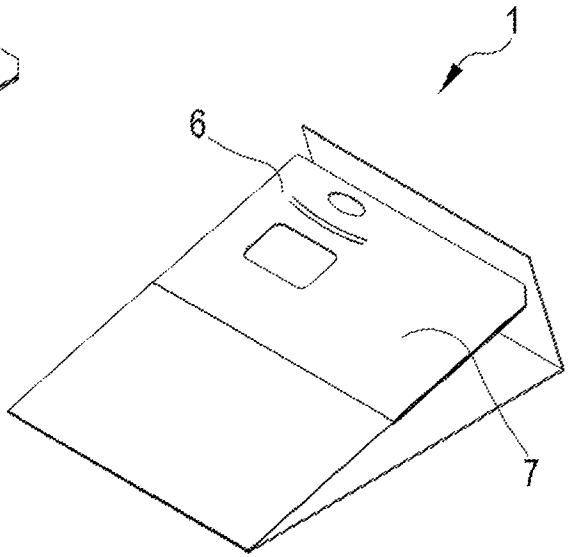
FIG. 13 is a perspective view of the support of FIG. 12 in a third partially-open condition.

The containing body 6 can preferably be provided with a plurality of additional portions, as illustrated in figures from 12 to 14. FIG. 12 illustrates a support 1 provided with a plurality of additional portions in a second condition of complete opening and FIG. 13 illustrates a support 1 provided with a plurality of additional portions in a third condition of partial opening in which the portions of the containing body 6 are reciprocally inclined.

Figure 14:
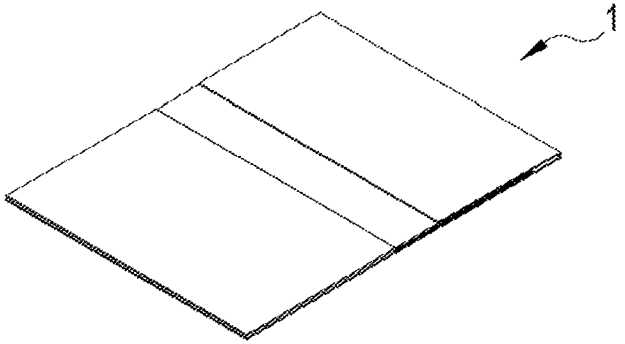
FIG. 14 is a perspective view of the support of FIG. 12 in a fourth partially-closed condition.
Figure 15:
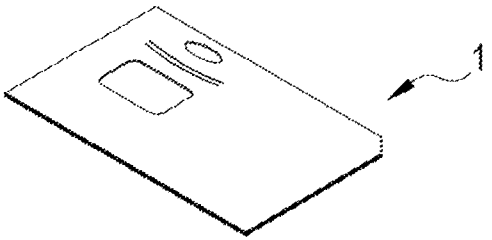
FIG. 15 is a perspective view of the support of FIG. 12 in a fifth closed condition.

A further configuration that can be assumed by a support 1 according to the concepts herein is illustrated in FIG. 14, where a support 1 is illustrated that is provided with a plurality of additional portions in a fourth condition of partial closure in which an additional portion of the containing body 6 is partly superposed on the first layer 7 of the containing body 6.

In relation to the third portion 5, it can be interposed between the first and the second portion 3, 4. The third portion 5 can exhibit one or more discontinuities of material interposed between the first portion 3 and the second portion 4 with the aim of preventing the samples of biological material deposited and conserved at the first portion 3 of the absorbent matrix 2 from contaminating the second portion 4 and, vice versa, preventing the biological material deposited at the second portion 4 during the cleaning of the collecting device from contaminating the first portion 3 of the absorbent matrix 2.

In accordance with a preferred embodiment of the concepts herein, the third portion 5 can exhibit at least a cut 11 or a plurality of cuts 11. The third portion 5 preferably exhibits two cuts 11. One or more cuts 11 characterising the third portion 5 can be through-cuts and interposed between the first and the second portion 3, 4, in particular with reference to the operating conditions of the containing body 6. A third portion 5 belonging to an absorbent matrix 2 and characterised by a cut 11 is for example illustrated in FIG. 6. The through-cuts 11 with respect to the third portion 5, constitute a discontinuity of material between the first and the second portion 3, 4; this discontinuity of material, as described in the foregoing, can prevent any reciprocal contamination between the first portion 3 and the second portion 4. One or more cuts 11 can exhibit an at least partly-curved development; the cuts 11 can preferably develop along an arc of circumference, as illustrated in FIG. 6. The cuts 11 can exhibit a longitudinal extension developing interposingly between the first portion 3 and the second portion 4. The longitudinal extension of the cuts can be greater than a corresponding longitudinal extension of the first portion 3 and/or the second portion 4 and/or of the first opening 9 and/or the second opening 10.

The containing body 6 can in turn be characterised by the presence of one or more cuts 11, in particular made at the first layer 7 and/or the second layer 8. The first layer 7 and/or the second layer 8 can be characterised by at least a cut 11, preferably two cuts 11, in particular a plurality of cuts 11.

Figure 2:
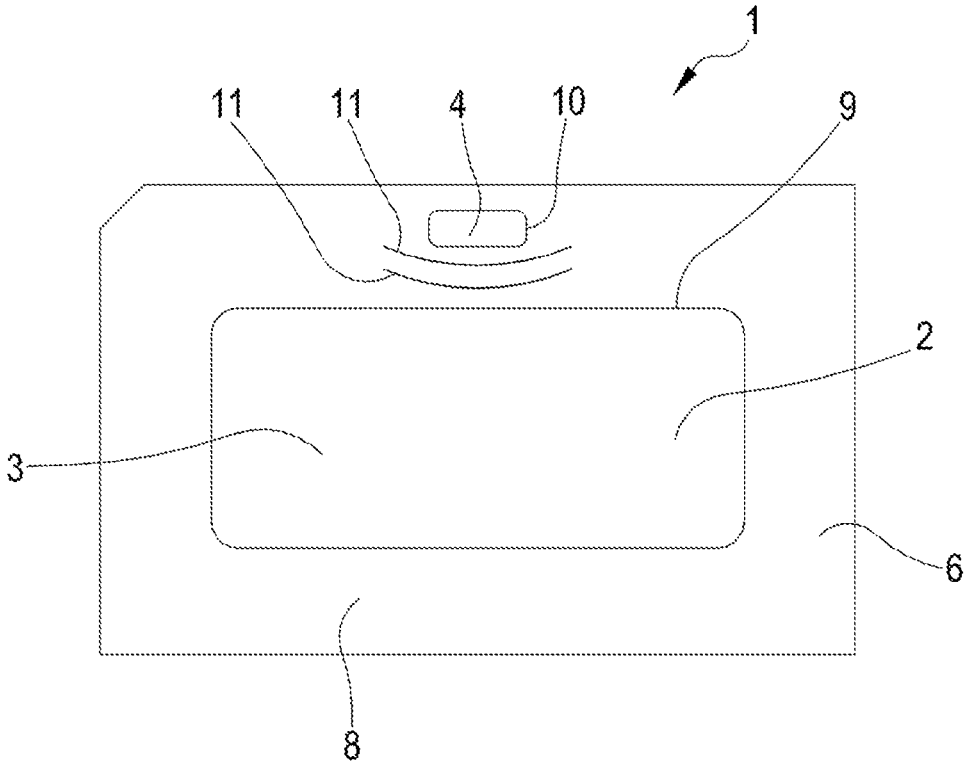
FIG. 2 is a rear view of the support of FIG. 1.
Figure 3:
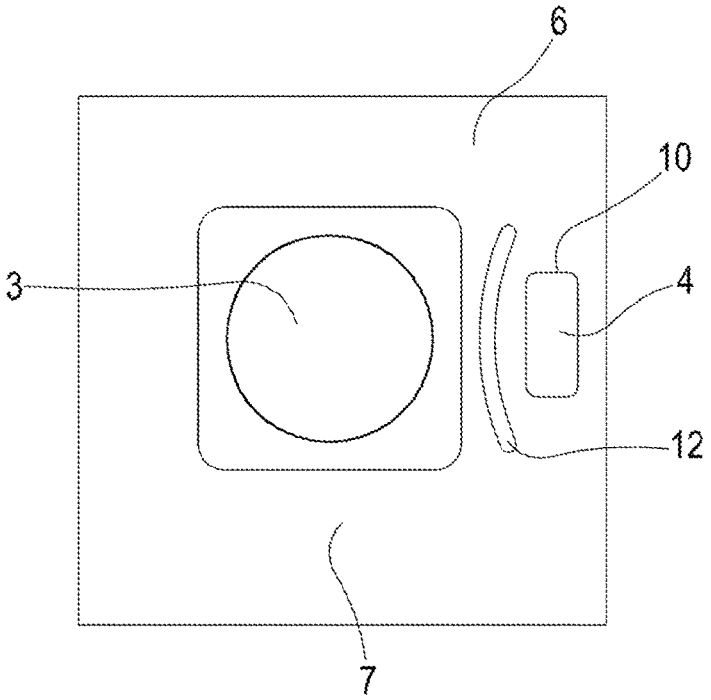
FIG. 3 is a frontal view of a support according to a variant of the concepts herein.

The presence of two cuts 11 at the first layer 7 is illustrated for example in FIG. 1, while the presence of two cuts 11 at the second layer 8 is illustrated in FIG. 2. The cuts 11 which can characterize the first layer 7 and/or the second layer 8 can be through-cuts with respect to the first layer 7 and the second layer 8. In the first layer 7 and the second layer 8 the cuts can preferably be interposed between the first and the second opening 9, 10. In particular, at least two between the first layer 7, the second layer 8 and the third portion 5 can be characterised by a same number of cuts 11. The first layer 7, the second layer 8 and the third portion 5 are preferably characterised by a same number of cuts 11. The cuts 11 can be made in corresponding positions on the first layer 7, the second layer 8 and/or the third portion 5. In particular, with reference to the operating conditions of the containing body 6, one or more cuts 11 of the first layer 7 can be positioned at and in particular superiorly of one or more cuts 11 of the third portion 5 and/or one or more cuts 11 of the second layer 8 can be positioned at, in particular below, one or more cuts 11 of the third portion 5.

With the corresponding positioning of the cuts 11 of the first layer 7, the second layer 8 of the containing body 6 and the third portion 5, the discontinuity of material constituted by the cuts 11 can constitute a through-cut with respect to the thickness S of the support 1. The thickness S of the support 1 can be evaluated in operating conditions of the containing body 6 as the sum of the thickness of the first layer 7 and the second layer 8 of the containing body and the thickness of the first portion 3 or the second portion 4 or the absorbent material 2. For example, FIG. 4 illustrates the thickness S of the support 1, represented as the sum of the thickness of the first layer 7 of the containing body 6, of the absorbent matrix 2 and the second layer 8 of the containing body 6. In particular, with reference to the operating conditions of the containing body 6, the cuts 11 of the first layer 7 of the containing body 6 can be superposed on the cuts 11 of the third portion 5, which can be in turn superposed on the cuts 11 of the second layer 8 of the containing body 6, constituting in this way a through-discontinuity of material with respect to the thickness S of the support 1.

The cuts 11 of the first and second layer 7, 8 and the third portion 5 are preferably characterised by the same dimensions and/or the same geometrical shape. As regards the cutting process of the absorbent matrix 2 and/or the containing body 6, one or more cuts 11 can be realized at the third portion 5, of the first layer 7 and/or the second layer 8 of the containing body 6 by die-cutting or punching. The die-cutting or punching can be realized on a support 1 for conservation of samples of biological material before or after an assembly of the third portion 5 in the containing body 6.

The assembly of the third portion 5 of the containing body 6 relates to the operation consisting in arranging the third portion 5 internally of the containing body 6, in particular interposed between the first layer 7 and the second layer 8. When the cutting operation is realized after the assembly operation of the third portion 5 internally of the containing body 6, with a single cutting operation one or more cuts 11 can be made at the first and second layer 7, 8 of the containing body 6 and the third portion 5. The cutting operation involves the step of realizing at least a cut 11, in particular a plurality of cuts 11, or one or more openings 12 at least at the third portion 5, for example by die-cutting or punching. The cutting operation can also involve the first layer 7 and/or the second layer 8 of the containing body 6.

In a variant of the concepts herein, the third portion 5 can exhibit at least an opening 12. The opening 12 is for example illustrated in FIGS. 7 and 8, where an absorbent matrix 2 is illustrated comprising the first, second and the third portion 3, 4, 5. The opening 12 is preferably a through-opening with respect to the third portion 5 and interposed between the first and the second portion 3, 4, in particular with reference to the operating conditions of the containing body 6. The opening 12 can exhibit any shape; in particular the opening 12 can exhibit a substantially circular shape, as illustrated in FIG. 8, or rectangular, as illustrated in FIG. 7. In particular, the third portion 5 can exhibit a plurality of openings 12, even of different shape and/or dimensions to one another.

As regards the containing body 6, it can in turn exhibit an opening 12. In particular, the first layer 7 and/or the second layer 8 of the containing body 6 can exhibit an opening 12 which can be distinguished by the characteristics of shape and/or the dimensions previously described with reference to the opening 12 of the third portion 5. In particular, when the first layer 7 and/or the second layer 8 exhibit a first and a second opening 9, 10, the opening 12 can be made in the portion of the first layer 7 and/or the second layer 8, interposed between the first and the second opening 9, 10.

Owing to the reciprocal and corresponding positioning thereof, the openings 12 of the first and second layer 7, 8 of the containing body 6 and the third portion 5 can constitute a through-discontinuity of material with respect to the thickness S of the support 1. In particular, with reference to the operating conditions of the containing body 6, the opening 12 of the first layer 7 of the containing body 6 can be superposed on the opening 12 of the third portion 5 of the absorbent matrix 2, which can be in turn superposed on the opening 12 of the second layer 8 of the containing body 6, constituting in this way a through-discontinuity of material with respect to the thickness S of the support 1.

The openings 12 of the first and second layer 7, 8 and the third portion 5 are characterised by having the same dimensions and/or the same geometrical shape. As regards the cutting operation of the absorbent matrix 2 and/or the containing body 6, one or more openings 12 can be realized at the third portion 5 of the absorbent matrix 2 of the first layer 7 and/or of the second layer 8 of the containing body 6, preferably by die-cutting or punching.

The die-cutting or punching operation can be realised on a support 1 for conservation of samples of biological material before or after an assembly of the third portion 5 in the containing body 6. When the die-cutting or punching is realized after the assembly operation of the third portion 5 internally of the containing body 6, by a single cutting operation one or more openings 12 are realized (as a function of the geometrical profile of the die or the punch used) at the first and the second layer 7, 8 of the containing body 6 and the third portion 5.

The concepts herein further relates to a production method of a support 1 of the previously-described type for conserving a sample of biological material. The method of the concepts herein preferably includes a step of realizing the first portion 3 of the absorbent matrix 2 and the second portion. The method can further comprise steps of associating the first and the second portion 2, 3 to the support 1 for conserving a sample of biological material. The assembly of the first portion 3 of the absorbent matrix 2 and the second portion 4 can be done separately or, in an embodiment in which the second portion 4 is a portion of the absorbent matrix, the assembly can be carried out by inserting the absorbent matrix 2 internally of the containing body 6, in particular between the first and the second layer 7, 8. The method of the concepts herein can include a step of realising at least a cut 11, in particular a plurality of cuts 11, or one or more openings 12, at the third portion 5. The method can comprise a step of inserting the first portion 3 and the second portion 4 and/or the third portion 5 and/or the absorbent matrix 2 internally of the containing body 6. The step of realizing one or more cuts 11 or one or more openings 12 at the third portion 5 can be carried out before or after the step of inserting the first portion 3 and the second portion 4 and/or the third portion 5 and/or the absorbent matrix 2 internally of the containing body 6. In particular, with reference to the assembly of the third portion 5, the step of realizing one or more cuts 11 or one or more openings 12 at the third portion 5 can be realized on a support 1 for conservation of samples of biological material before or after an assembly of the third portion 5 in the containing body 6.

In a method according to the concepts herein in which the step of realising one or more cuts 11 or one or more openings 12 at the third portion 5 is carried out after the step of inserting the third portion 5 and/or the absorbent matrix 2 internally of the containing body 6, it is advantageously possible, by a single cutting operation, to cut or realize one or more openings 12 at the third portion 5 of the first and the second layer 7, 8 of the containing body 6.

The step of realising one or more cuts 11 or one or more openings 12 at the third portion 5 can preferably be realised by die-cutting or punching. One or more cuts 11 or one or more openings 12 of the third portion 5, of the first layer 7 and/or of the second layer 8 of the containing body 6 can be realized according to the present method in such a way as to be reciprocally positioned in specific arrangements, as described in the following.

In particular, with reference to the operating conditions of the containing body 6, one or more cuts 11 or one or more openings 12 of the first layer 7 can be positioned at, and in particular above, one or more cuts 11 or one or more openings 12 of the third portion 5 and/or one or more cuts 11 or one or more openings 12 of the second layer 8 can be positioned at, in particular below, one or more cuts 11 or one or more openings 12 of the third portion 5.

The concepts herein enable obtaining one or more of the following advantages and obviating one or more of the problems encountered in the prior art.

First, the invention enables conserving a sample of biological material and the cleaning of the collecting device by a support which obviates the need to provide a separate cleaning support specifically included for the collecting device. The concepts herein enable avoiding contamination of the portion of the absorbent matrix for conservation of a sample of biological material. The concepts herein enables a simpler and rapider cleaning of the collecting device. The invention is also easy to use, to actuate and is simple and economical to manufacture.

The invention claimed is:

1. A support for conserving a sample of biological material, the support comprising:

a first portion of an absorbent matrix configured for conservation of a sample of biological material; and a second portion of the absorbent matrix distinct from the first portion and configured to constitute a cleaning zone for a head of a punch aimed at collecting a sample of biological material from the first portion, wherein the support further comprises a third portion of the absorbent matrix which connects the first portion and the second portion and is interposed between the first portion and the second portion, and wherein the third portion of the absorbent matrix comprises a through-cut interposed between the first portion of the absorbent matrix and the second portion of the absorbent matrix; said through-cut constituting a discontinuity of material between the first portion and the second portion of absorbent matrix with the aim of preventing reciprocal contamination between the first portion and the second portion;

the support further comprising an external containing body, the external containing body comprising a first layer and a second layer, in operating conditions of the containing body the first portion and the second portion and/or the absorbent matrix being arranged internally of the containing body between the first layer located superiorly with respect to the first and the second portion and/or to the absorbent matrix and the second layer located inferiorly with respect to the first and the second portion and/or to the absorbent matrix.

2. The support of claim 1, wherein the first portion and/or the second portion and/or a third portion of connection between the first portion and the second portion and/or the absorbent matrix are made of a cellulose-based material and/or of a paper material.

3. The support of claim 1, wherein the first and/or the second layer exhibit a first and a second opening, in operating conditions of the containing body the first portion being arranged at, and coinciding with, the first opening and the second portion being arranged at, and coinciding with, the second opening.

4. The support of claim 1, wherein the through-cut exhibits a longitudinal extension interposed between the first portion and the second portion that is greater with respect to a corresponding longitudinal extension of the first portion and/or the second portion and/or the first opening and/or the second opening and/or wherein the third portion is provided with at least two of the through-cuts and/or a plurality of the through-cuts.

5. The support of claim 1, wherein the third portion exhibits an opening in the absorbent matrix aimed at constituting a discontinuity of material in the absorbent matrix and interposed between the first portion and the second portion and/or wherein the opening in the absorbent matrix exhibits a longitudinal extension interposed between the first portion and the second portion that is greater than a corresponding longitudinal extension of the first portion and/or the second portion and/or the first opening and/or the second opening.

6. The support of claim 1, wherein the first portion of the absorbent matrix is configured to absorb and conserve a sample of biological material and is chemically treated so as to increase conservation over time of the sample of biological material and/or wherein the first portion is configured, by addition of specific substances suitable for the purpose, for absorbing and conserving samples of biological material.

* * * * *